United States Patent [19]

Boyer

[11] 4,191,221

[45] Mar. 4, 1980

[54] SHEETING FABRIC FORMED OF CORESPUN YARNS

[75] Inventor: Hugh J. Boyer, Eden, N.C.

[73] Assignee: Fieldcrest Mills, Inc., Eden, N.C.

[21] Appl. No.: 938,031

[22] Filed: Aug. 30, 1978

[51] Int. Cl.[2] ..... D03D 15/00; D02G 3/36

[52] U.S. Cl. ..... 139/426 R; 57/210

[58] Field of Search ..... 139/383 R, 420 R, 426 R; 57/210

[56] References Cited

U.S. PATENT DOCUMENTS

| | | | |
|---|---|---|---|
| 2,483,861 | 10/1949 | Weiss | 57/210 |
| 3,828,544 | 8/1974 | Alker | 57/210 |

*Primary Examiner*—Henry Jaudon

*Attorney, Agent, or Firm*—Bell, Seltzer, Park & Gibson

[57] ABSTRACT

A percale sheeting fabric of polyester and cellulosic fiber construction which more effectively utilizes the beneficial properties of the cellulosic fiber as compared to conventional polyester and cotton blend sheeting fabric constructions so as to provide a greatly increased moisture absorbency rate for enhanced comfort, and with enhanced cover, bulk and opacity. The fabric is formed of warp and filling yarns of corespun construction having a yarn count of about 34/1 to 37/1 cotton count, with the yarns being interwoven to form a woven fabric construction of at least about 180 threads per square inch. Each of the corespun warp and filling yarns has a core portion formed of multifilament polyester of a total denier of about 45 to 50, and a sheath portion formed of cellulosic fibers helically wrapped about the multifilament core portion to substantially surround and encase the same.

6 Claims, 2 Drawing Figures

SHEETING FABRIC FORMED OF CORESPUN YARNS

FIELD OF THE INVENTION

This invention relates to a sheeting fabric, and in particular to a woven percale sheeting fabric of polyester and cellulosic fiber construction.

BACKGROUND OF THE INVENTION

Percale sheeting fabric from which fine luxury percale bedsheets and pillowcases are produced is characterized by a plain weave construction of a high thread count of at least about 180 threads per square inch. Formerly, percale sheets were formed from 100 percent cotton fibers, but today nearly all percale sheets are of the permanent press type and formed of a blend of polyester and cotton fibers, with the cotton usually comprising about half but sometimes as little as 35 percent of the weight of the fabric.

The polyester fibers are included in the polyester and cotton blend sheeting fabric to reduce cost and to improve the strength, durability, dimensional stability, and wash and wear performance of the fabric. However, because of the reduced amount of cotton fiber, the polyester and cotton blend sheeting fabrics generally have a less luxurious appearance and feel than all cotton sheeting fabrics, and are less absorbent and consequently less comfortable than all cotton sheeting fabrics.

A principal object of the present invention is to provide a polyester and cellulosic fiber sheeting fabric having certain physical and aesthetic characteristics which are more luxurious than and superior to the characteristics of the fiber blend sheeting fabrics which are presently known.

It is a further object of this invention to provide a percale sheeting fabric of polyester and cellulosic fiber construction which more effectively utilizes the beneficial properties of the cellulosic fiber as compared to conventional polyester and cotton blend fabric constructions so as to provide a greatly increased moisture absorbency rate for enhanced comfort, and with enhanced cover, bulk, and opacity.

SUMMARY OF THE INVENTION

These and other objects of this invention are accomplished by a unique polyester and cellulosic fiber sheeting fabric construction in which the cellulosic fibers are located at the surface of the yarns for improved aesthetic appeal and improved physical characteristics, with the polyester fibers being located in the core of the yarns to give strength and durability to the fabric.

More particularly, the sheeting fabric of the present invention is formed of warp and filling yarns of corespun construction with each of the corespun warp and filling yarns having a core portion of multifilament polyester and a sheath portion formed of cellulosic fibers helically wrapped about the multifilament polyester core portion to substantially surround and encase the multifilament polyester core.

The cellulosic fibers which form the sheath portion of the yarns may be either cotton or rayon and comprise at least 65 percent by weight of the corespun yarn. The corespun warp and filling yarns have a yarn count of about 34/1 to 37/1 and are interwoven to form a closely woven plain weave fabric of at least about 180 threads per square inch, and wherein the picks per inch are approximately 10 to 20 percent less than the warp ends per inch.

This unique construction for a sheeting fabric provides a number of properties or advantages not heretofore obtainable in conventional polyester and cotton blend sheeting fabrics. Sheeting fabrics constructed in accordance with this invention have an all cellulosic fiber surface which provides a number of desirable aesthetic and functional properties, while the polyester core gives strength and durability to the fabric.

The fabric exhibits noticeably better fabric cover or opacity than conventional polyester and cotton blend sheeting fabrics, thus giving the fabric more body, bulk, and apparent value. This property is largely due to the fact that the cellulosic fiber is located at the surface of the fabric, which takes advantage of the natural "bloom" or cover that the fiber develops during wet finishing. The unique structure of cotton fibers also contributes to the enhancement of the cover factor. In this regard, cotton fibers have an irregularly shaped cross section as compared to the polyester fibers used in sheeting. The presence of these irregularly shaped fibers at the surface of the fabric enhances the opacity or cover factor of the fabric. In addition, the natural twists or convolutions inherent in a cotton fiber, which may average at least 125 twists per inch, also contribute to the improved cover factor or opacity.

The fabrics also have a smooth, pleasing surface texture with the natural feel and sheen of an all cotton sheeting fabric. In addition, the polyester and cotton sheeting fabric in accordance with the present invention has a crepe appearance that is unique in a sheeting fabric and which is caused by the construction of the yarn itself. In this regard, the cotton sheath of the corespun yarn, due to the helical formation around the surface of the polyester core and due to the natural convolutions or twists in the cotton fibers, tends to give the fabric a crepe or pebbly texture. In conventional cotton and polyester blend sheeting fabrics, the cotton fibers are uniformly blended with polyester fibers which generally have a smooth round surface. Thus, the unique visual effects of the cotton fiber, caused by its irregular shape and natural convolutions, are lessened considerably by the blending. However, in the corespun cotton and polyester sheeting fabric construction of this invention, these unique characteristics of the cotton fiber are highlighted by the fact that all of the cotton is on the outer surface of the yarn.

Sheeting fabrics formed of corespun yarns in accordance with this invention have a rate of moisture absorbency which is approximately three times that of conventional cotton and polyester blend sheeting fabrics. This enables the fabric to wick moisture away from the body much more rapidly, thereby providing a greatly enhanced comfort factor. This higher rate of absorbency is due to the fact that the hydrophilic cellulosic fibers are located on the surface of the fabric, thus allowing better utilization of the beneficial hygroscopic properties of the cellulosic fiber than is the case in conventional polyester and cotton blend sheeting fabric where the cotton fibers are uniformly blended throughout the yarn structure, with many of the cotton fibers thus being buried within the yarns.

BRIEF DESCRIPTION OF THE DRAWING

Some of the objects of the invention having been stated, other objects will appear as the description proceeds, when taken in connection with the accompanying drawing, in which.

DESCRIPTION OF PREFERRED EMBODIMENTS

Figure 1:
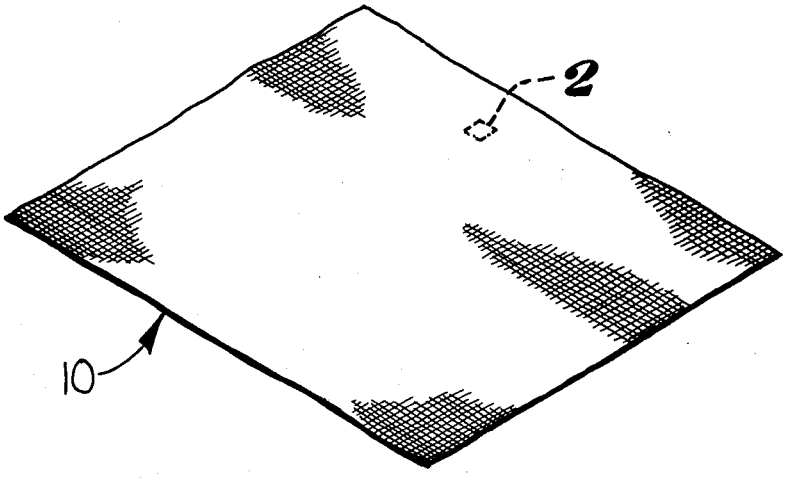
FIG. 1 is a perspective fragmentary view of a typical percale sheeting fabric formed in accordance with this invention.
Figure 2:
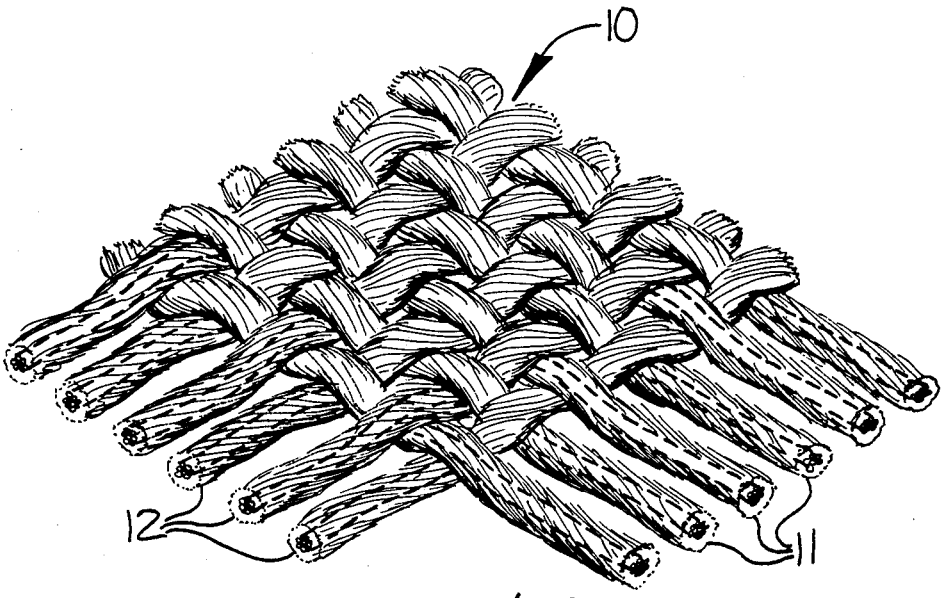
FIG. 2 is an enlarged schematic view of an area 2 of FIG. 1, illustrating a typical manner in which the corespun filling and warp yarns are interwoven.

The corespun yarn used in both the warp 11 and filling 12 of the sheeting fabric 10 is produced on a spinning frame in a manner known in the art. The cellulosic fiber roving is processed through a conventional drafting system on a standard cotton system spinning frame. The polyester filament yarn is introduced to the middle of the flow of cellulosic fiber stock just behind the front roll of the drafting system. By this means, the polyester filament yarn is not drafted but simply pulled under the nip of the front roll with the cellulosic fibers. Then, since the polyester yarn is a continuous strand, it is held in place between the nip of the front roll and the spindle, and as a result becomes the core or center of the yarn as the cellulosic fibers are twisted around the filament core to form the outer sheath of the yarn.

For the cellulosic fiber sheath portion of the corespun yarn, either cotton or rayon roving is used at the spinning frame to wrap the polyester filament core. In a cotton and polyester corespun yarn, roving of 100 percent combed cotton fibers is employed. To provide uniform coverage of the polyester filament core, the cotton fibers should have a staple length of at least 1 1/16 inch.

Where rayon is used for the sheath portion of the corespun yarn, the rayon should have a staple length of from 1¼ to 2 inches and should be from 1.25 to 2.25 denier, preferably 1.5 denier, 1 9/16 inch staple length. This fine denier fiber is needed for surface smoothness and suppleness, and the finer denier will also provide the optimum number of fibers per cross section for an adequate coverage of the polyester filament core. The rayon fiber should preferably be a high wet modulus or polynosic type rayon, so as to provide optimum strength and dimensional stability during wet finishing and during laundering of the finished product. This type of rayon is also much more resistant to degradation by caustic soda used in mercerization processes and the resin finishes used for permanent press treatments than is regular rayon.

The core portion of the corespun yarn is formed of continuous filament polyester yarn. The polyester filament core should be a multifilament yarn as opposed to a monofilament yarn, with a sufficiently low denier per filament so as to maintain suppleness and pliability to the yarn and in turn to the woven fabric itself. Multifilament polyester yarn of two to four denier per filament has been found to provide a desirable level of suppleness and pliability to the yarn and fabric. It is desirable to have the minimum amount of twist in this polyester filament yarn so as to provide a smooth surface for the even application of the sheath fibers.

In order to maintain adequate tensile strength in the finished fabric, it has been found necessary to use a polyester filament core yarn with a total denier of at least about 45 in both the warp and filling. However, to maintain the desired physical and aesthetic characteristics in the fabric, it is necessary that the total denier not exceed about 50. In this regard, the percentage of cellulosic fiber in the corespun warp and filling yarns must be kept to a level of at least 65 percent to provide a sufficient amount of cellulosic fiber to adequately cover the filament core. Therefore, the total denier of the multifilament core yarn becomes critical in maintaining the overall blend level while keeping the total yarn count within the range of 34/1 to 37/1 cotton count. Within this yarn count range, a percale corespun sheeting fabric of at least 180 total thread count can be satisfactorily constructed while maintaining acceptable aesthetic qualities such as softness and suppleness, and acceptable physical standards such as physical strength, weight, and cover.

Unlike conventional percale sheeting fabric construction which normally has coarser warp yarns than filling yarns, the present invention preferably utilizes warp and filling yarns of the same yarn count. The fabric is woven so that when finished, the picks per inch are approximately 10 to 20 percent less than the warp ends per inch. Thus for example, a typical greige fabric construction would utilize a 36/1 corespun cotton/polyester yarn in both warp and filling, with 90 ends and 83 picks, which after finishing results in 100 ends and 80 picks. The 36/1 yarn would have a 50 denier 24 filament polyester core, resulting in an overall blend of 66 percent cotton and 34 percent polyester.

EXAMPLE

To demonstrate the dramatic increase in the moisture absorbency of a corespun polyester and cotton percale sheeting fabric in accordance with this invention as compared to conventional polyester and cotton blend sheeting fabrics, comparative tests were conducted according to AATCC Test Method 79-1975 entitled "Absorbency of Bleached Woven Cloth." In this test, a drop of water is allowed to fall onto the taut surface of the woven fabric test specimen and the time required for the drop to be absorbed into the fabric is measured and recorded as wetting time. The more absorbent the fabric, the shorter is the wetting time.

Sheeting fabric specimens of a corespun polyester and cotton and percale sheeting fabric in accordance with this invention and a conventional polyester and cotton blend sheeting fabric were tested. The construction of these fabrics and the wetting times are shown in Table 1.

Table 1

| Fabric | | Wetting Time |
|---|---|---|
| Conventional polyester/cotton sheeting | | 90 seconds |
| 100 ends 80 picks | | |
| warp yarn: | 35/1 cotton count, blend of 50% polyester 50% cotton | |
| filling yarn: | 39/1 cotton count, blend of 50% polyester 50% cotton | |
| Corespun polyester/cotton sheeting | | 27 seconds |
| 100 ends 80 picks | | |
| warp and filling: | 36/1 cotton count corespun yarn with 50/24 polyester core and 1-3/32 inch cotton sheath 34% polyester 66% cotton | |

This test shows that the absorbency rate of a cotton and polyester corespun sheeting fabric in accordance with this invention is more than three times that of the conventional polyester and cotton blend sheeting fabric. The rate of absorbency of a rayon and polyester corespun sheeting fabric is even greater than that of the cotton and polyester corespun fabric, since the rayon has a moisture regain of approximately 13 percent as compared to approximately 7 percent for cotton.

In the drawing and specification, there has been set forth a preferred embodiment of the invention, and although specific terms are employed, they are used in a generic and descriptive sense only and not for purposes of limitation.

That which is claimed is:

1. A percale sheeting fabric of polyester and cellulosic fiber construction which more effectively utilizes the beneficial properties of the cellulosic fiber as compared to conventional polyester and cotton blend sheeting fabric constructions so as to provide a greatly increased moisture absorbency rate for enhanced comfort, and with enhanced cover, bulk, and opacity, said fabric being formed of warp and filling yarns of corespun construction having a yarn count of about 34/1 to 37/1 cotton count and being interwoven to form a woven fabric construction of at least about 180 threads per square inch and wherein the picks per inch are approximately 10 to 20 percent less than the warp ends per inch, each of the corespun warp and filling yarns having a core portion formed of multifilament polyester of 2 to 4 denier per filament and of a total denier of about 45 to 50, and having a sheath portion formed of cellulosic fibers of a staple length of at least 1 1/16 inch, the cellulosic fibers being helically wrapped about the multifilament polyester core portion to substantially surround and encase the same, and said cellulosic fibers comprising at least 65 percent by weight of the corespun yarn.

2. A fabric according to claim 1 wherein said corespun warp yarns are of the same yarn count as said corespun filling yarns.

3. A fabric according to claim 1 wherein said cellulosic fibers forming the sheath portion of the corespun yarn are combed cotton fibers.

4. A fabroic according to claim 1 wherein said cellulosic fibers forming the sheath portion of the corespun yarns are rayon fibers of a staple length of 1¼ to 2 inches and 1.25 to 2.25 denier.

5. A polyester and cotton percale sheeting fabric of a construction which more effectively utilizes the beneficial properties of the cotton fiber as compared to conventional polyester and cotton blend sheeting fabric constructions so as to provide a greatly increased moisture absorbency rate for enhanced comfort, and with enhanced cover, bulk, and opacity, said fabric being formed of warp and filling yarns of corespun construction having a yarn count of about 34/1 to 37/1 cotton count and being interwoven to form a woven fabric construction of at least about 180 threads per square inch and wherein the picks per inch are approximately 10 to 20 percent less than the warp ends per inch, the corespun warp and filling yarns being of the same yarn count and each having a core portion formed of multifilament polyester of 2 to 4 denier per filament and a total denier of about 45 to 50, and having a sheath portion formed of combed cotton of a staple length of at least 1 1/16 inch, the cotton fibers being helically wrapped about the multifilament polyester core portion to substantially surround and encase the same, and said cotton fibers comprising at least 65 percent by weight of the corespun yarn.

6. A polyester and rayon sheeting fabric of a construction which more effectively utilizes the beneficial properties of the rayon fiber as compared to conventional polyester and cotton blend sheeting fabric constructions so as to provide a greatly increased moisture absorbency rate for enhanced comfort, and with enhanced cover, bulk, and opacity, said fabric being formed of warp and filling yarns of corespun construction having a yarn count of about 34/1 to 37/1 cotton count and being interwoven to form a woven fabric construction of at least about 180 threads per square inch and wherein the picks per inch are approximately 10 to 20 percent less than the warps ends per inch, the corespun warp and filling yarns being of the same yarn count and each having a core portion formed of multifilament polyester of 2 to 4 denier per filament and a total denier of about 45 to 50, and having a sheath portion formed of rayon fibers of a staple length of 1¼ to 2 inches and of 1.25 to 2.25 denier, the rayon fibers being helically wrapped about the multifilament polyester core portion to substantially surround and encase the same, and said rayon fibers comprising at least 65 percent by weight of the corespun yarn.

* * * * *

UNITED STATES PATENT AND TRADEMARK OFFICE

CERTIFICATE OF CORRECTION

PATENT NO. : 4,191,221

DATED : March 4, 1980

INVENTOR(S) : Hugh J. Boyer

It is certified that error appears in the above-identified patent and that said Letters Patent are hereby corrected as shown below:

Column 3, Line 6, "an" should be omitted after "of".

Column 5, Line 38, CLAIM 3, "yarn" should be --yarns--; same column, Line 39, CLAIM 4, "fabroic" should be --fabric--

Column 6, Line 33, CLAIM 6, "warps" should be --warp--.

Signed and Sealed this

*Tenth* Day of *June 1980*

[SEAL]

*Attest:*

SIDNEY A. DIAMOND

*Attesting Officer*

*Commissioner of Patents and Trademarks*